US008330583B2

(12) United States Patent
Beard et al.

(10) Patent No.: US 8,330,583 B2
(45) **Date of Patent: *Dec. 11, 2012**

(54) METHOD AND SYSTEM FOR CONTROLLING RADIO CONTROLLED DEVICES

(75) Inventors: Paul Beard, Bigfork, MT (US); John Adams, Champaign, IL (US); Mathew Lee, Oklahoma City, OK (US); Eric Meyers, Greenville, SC (US)

(73) Assignee: Horizon Hobby, Inc., Champaign, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/267,548

(22) Filed: Oct. 6, 2011

(65) Prior Publication Data

US 2012/0027049 A1 Feb. 2, 2012

Related U.S. Application Data

(63) Continuation of application No. 12/214,105, filed on Jun. 17, 2008, now Pat. No. 8,049,600, which is a continuation of application No. 11/252,984, filed on Oct. 18, 2005, now Pat. No. 7,391,320.

(60) Provisional application No. 60/667,286, filed on Apr. 1, 2005.

(51) Int. Cl.
*G08C 19/16* (2006.01)

(52) U.S. Cl. ..... 340/12.22; 340/870.11; 340/870.17; 340/870.28; 340/870.01; 446/456; 455/352

(58) Field of Classification Search ..... None
See application file for complete search history.

(56) References Cited

U.S. PATENT DOCUMENTS

| | | | | |
|---|---|---|---|---|
| 4,177,426 | A | | 12/1979 | Gaishin et al. |
| 4,406,085 | A | * | 9/1983 | Rhodes ..... 446/456 |
| 4,480,401 | A | | 11/1984 | Matsushiro |
| 4,521,644 | A | | 6/1985 | Bernard, Jr. |
| 4,763,121 | A | | 8/1988 | Tomoda et al. |
| 5,068,889 | A | | 11/1991 | Yamashita |
| 5,132,679 | A | | 7/1992 | Kubo et al. |
| 5,249,302 | A | | 9/1993 | Metroka et al. |
| 5,330,380 | A | | 7/1994 | McDarren et al. |
| 5,481,257 | A | | 1/1996 | Brubaker et al. |
| 5,635,923 | A | | 6/1997 | Steele et al. |
| 5,816,352 | A | | 10/1998 | Hacker |
| 5,841,390 | A | | 11/1998 | Tsui |
| 5,885,159 | A | | 3/1999 | DeAngelis |
| 5,898,386 | A | | 4/1999 | Kaihatsu |

(Continued)

FOREIGN PATENT DOCUMENTS

WO PCT/US84/01899 6/1985

*Primary Examiner* — Benjamin C Lee
*Assistant Examiner* — Curtis King
(74) *Attorney, Agent, or Firm* — Suiter Swantz pc 11o

(57) ABSTRACT

The present invention is a method and system for controlling a RC device via a secure radio link. In one embodiment of the invention, spread spectrum modulation may be employed which may provide a digital radio frequency (RF) link between a controller and a RC device. A controller may be coupled with a transmitter module and a radio controlled device may be coupled with a receiver module in accordance with the present invention to provide an add-on upgrade capability. The method and system for controlling a RC device may also include error detection and correction, interpolation of lost packets, failsafe technology and force-feedback telemetric technology to further enhance the user experience with radio controlled devices.

6 Claims, 14 Drawing Sheets

U.S. PATENT DOCUMENTS 5,933,090 A 8/1999 Christenson
5,940,035 A 8/1999 Hedrick
5,996,028 A 11/1999 Niimi et al.
6,178,167 B1 1/2001 Fraser
6,215,389 B1 4/2001 Schmidt
6,315,630 B1 11/2001 Yamasaki
6,315,667 B1 11/2001 Steinhart
6,320,514 B1 11/2001 Flick
6,335,576 B1 1/2002 Wallace
6,356,209 B1 3/2002 Mitchell et al.
6,392,565 B1 5/2002 Brown
6,483,426 B1 11/2002 Pagnol et al.
6,497,608 B2 * 12/2002 Ho et al. ..... 446/456
6,525,669 B1 2/2003 Ohashi et al.
6,546,006 B1 4/2003 Fraser
6,589,098 B2 7/2003 Lee et al.
6,618,580 B2 9/2003 Parrott et al.
6,636,197 B1 10/2003 Goldenberg et al.
6,657,535 B1 12/2003 Magbie et al.
6,697,415 B1 2/2004 Mahany
6,719,607 B2 * 4/2004 Aldred et al. ..... 446/454
6,722,610 B1 4/2004 Rawdon et al.
6,766,168 B1 7/2004 Lim
6,778,097 B1 8/2004 Kajita et al.
6,823,399 B2 11/2004 Horiguchi et al.
6,888,880 B2 5/2005 Lee et al.
6,893,320 B2 * 5/2005 Caiozza ..... 446/456
6,983,128 B2 1/2006 Wright
7,217,192 B2 * 5/2007 Nishiyama ..... 463/43
2001/0002813 A1 6/2001 Seki et al.
2001/0004375 A1 * 6/2001 Partyka ..... 375/135
2001/0021199 A1 9/2001 Lee et al.
2003/0043053 A1 * 3/2003 Schuckel ..... 340/825.69
2003/0043268 A1 3/2003 Mann
2004/0147202 A1 * 7/2004 Brabrand ..... 446/454
2004/0249519 A1 * 12/2004 Frink ..... 701/3
2005/0189342 A1 9/2005 Kabbani
2005/0266808 A1 12/2005 Reunamaki et al.
2005/0286646 A1 12/2005 Fails et al.
2006/0045115 A1 3/2006 Nix et al.
2006/0061458 A1 3/2006 Simon et al.
2006/0102798 A1 * 5/2006 Cox et al. ..... 244/190
2006/0119468 A1 6/2006 Van Swaay
2006/0144994 A1 7/2006 Spirov et al.
2006/0164383 A1 7/2006 Machin et al.
2006/0255683 A1 11/2006 Suzuki et al.
2009/0005167 A1 1/2009 Arrasvuori et al.

* cited by examiner

METHOD AND SYSTEM FOR CONTROLLING RADIO CONTROLLED DEVICES

CROSS REFERENCE TO RELATED APPLICATIONS

The present application is a continuation application and claims the benefit of U.S. Non-Provisional application Ser. No. 12/214,105 filed Jun. 17, 2008 which is a continuation application and claims the benefit of U.S. Non-Provisional application Ser. No. 11/252,984, filed Oct. 18, 2005, issued as U.S. Pat. No. 7,391,320 on Jun. 24, 2008. Said U.S. Non-Provisional application Ser. No. 11/252,984, filed Oct. 18, 2005 claims the benefit of U.S. Provisional Application Ser. No. 60/667,286 filed Apr. 1, 2005.

The U.S. Non-Provisional application Ser. No. 12/214,105 filed Jun. 17, 2008, the U.S. Non-Provisional application Ser. No. 11/252,984, filed Oct. 18, 2005 and the U.S. Provisional Application Ser. No. 60/667,286 filed Apr. 1, 2005 are hereby incorporated by reference in their entirety.

FIELD OF THE INVENTION

The present invention generally relates to radio controlled (RC) devices and more particularly to a system and method for controlling radio controlled devices.

BACKGROUND OF THE INVENTION

Radio controlled (RC) devices, including radio controlled model vehicles, such as cars, boats, helicopters and planes are enjoyed by hobbyists recreationally and competitively. Referring to FIG. 1, a radio controlled system 100 known to the art is shown. Conventional radio controlled system 100 may include a radio controlled device 110 and a hand-held controller 120. The radio controlled device 110, such as a car, is typically controlled by a user through the use of a hand-held controller 120 that transmits radio signals corresponding to the user's input to a radio receiver component of the radio controlled device. This allows the user to control a speed and direction of movement of the radio controlled device 110 via the hand-held controller 120.

A common problem associated with conventional RC devices is the disruption in the radio signal between a hand-held controller and the receiver of the radio controlled device. For instance, conventional radio controlled devices may have a limited range of operation. Additionally, radio signals may be disrupted due to interference caused by noisy motors, speed controllers, garage door openers, wireless communication devices and the like.

Another source of interference is produced by other radio signals for other radio controlled devices. It is commonplace for several users to be operating radio controlled devices in the same geographical area. FIG. 2 depicts multiple radio controlled systems 200 in the same geographical area. For example, races of radio controlled devices may be held on a track with several contestants. Conventional RC devices monitor an assigned frequency, such as 27.9 megaHertz (MHz), for a signal. Two devices operating next to each other on the same frequency may cause loss of control and may cause a collision of the devices. For example, hand-held controller 210 operating with radio controlled device 220 may cause interference between hand-held controller 230 and radio controlled device 240. Transmitters and receivers are generally equipped with frequency crystals, allowing a transmitter to send signals to a receiver on a specific frequency.

The purpose of these crystals is to ensure that signals from one device do not interfere with signals from another device. However, crystals are costly for RC device operators, and frequency monitoring is an additional undesirable limitation. Additionally, frequencies must be assigned to operators before operation of an RC device, causing a delay before operation may begin. This may significantly reduce practice time for professional RC device operators and negatively impact the enjoyment of hobbyists.

With respect to radio controlled aircraft devices, another disadvantage of conventional transmission methods is multipath fading. Multipath fading may occur when a radio wave follows more than one path between a transmitter and receiver. Propagation paths may include a ground wave, ionospheric refraction, re-radiation by the ionospheric layer and other such paths. Because of the various obstacles and reflectors in a wireless propagation channel, a transmitted signal, or signals, may travel different paths and arrive at a destination point at different times and from different directions. Specifically, signals that are received in phase may reinforce one another. However, signals that are received out of phase may produce a weak or fading signal. Further, the receiver will be subject to varying levels of signal reception as it moves around, caused by constructive and destructive addition of the impinging waves due to their different phase offsets. Conventional RC aircraft device systems are subject to fading signal loss, potentially causing damage or destruction of the aircraft device.

Radio controlled aircraft devices may also be subject to intersymbol interference (ISI). ISI may be caused by multipath fading and is generally known as frequency fading due to time dispersion. Time dispersion sets a time limit on the speed at which modulated data bits or symbols may be transmitted in a channel. Because of the dispersion, symbols may collide and result in distorted output data. Differences in delay between various reflections arriving at the receiver may be a significant fraction of the data symbol interval, establishing conditions for overlapping symbols. ISI may occur if the data symbol duration is the same magnitude or smaller than the delay spread of the channel. As the data rate increases, the number of symbols affected by ISI increases. A receiver may not be capable of reliably distinguishing between individual elements and, at a certain threshold, ISI may compromise the integrity of received data. Because conventional RC aircraft devices cannot resolve multipath fading, they are unable to prevent intersymbol interference, resulting in transmitted data that may be substantially compromised upon arrival at a receiver.

Conventional radio controlled aircraft devices are also unable to prevent an aircraft device from operating according to an incorrect model program. A radio controlled device operator may be unable to determine the model program corresponding to his radio controlled device. While an aircraft device may function properly when operated under an incorrect model program under certain circumstances, an aircraft device operator may be more likely to lose control of the radio controlled device. A radio controlled aircraft device may be damaged or destroyed if an operator is unable to control the device, resulting in costly repairs or replacement of the device.

Consequently, a system and method for controlling RC devices which may provide a secure, interference-free link between receiver and transmitter, substantially eliminate fading, and provide model program detection and selection is necessary.

SUMMARY OF THE INVENTION

Accordingly, the present invention is a method and system for controlling a RC device via a secure radio link. In one embodiment of the invention, spread spectrum modulation may be employed which may provide a digital radio frequency (RF) link between a controller and a RC device. A controller may be coupled with a transmitter module and a radio controlled device may be coupled with a receiver module in accordance with the present invention to provide an add-on upgrade capability. The method and system for controlling a RC device may also include error detection and correction, interpolation of lost packets, failsafe technology and force-feedback telemetric technology to further enhance the user experience with radio controlled devices.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
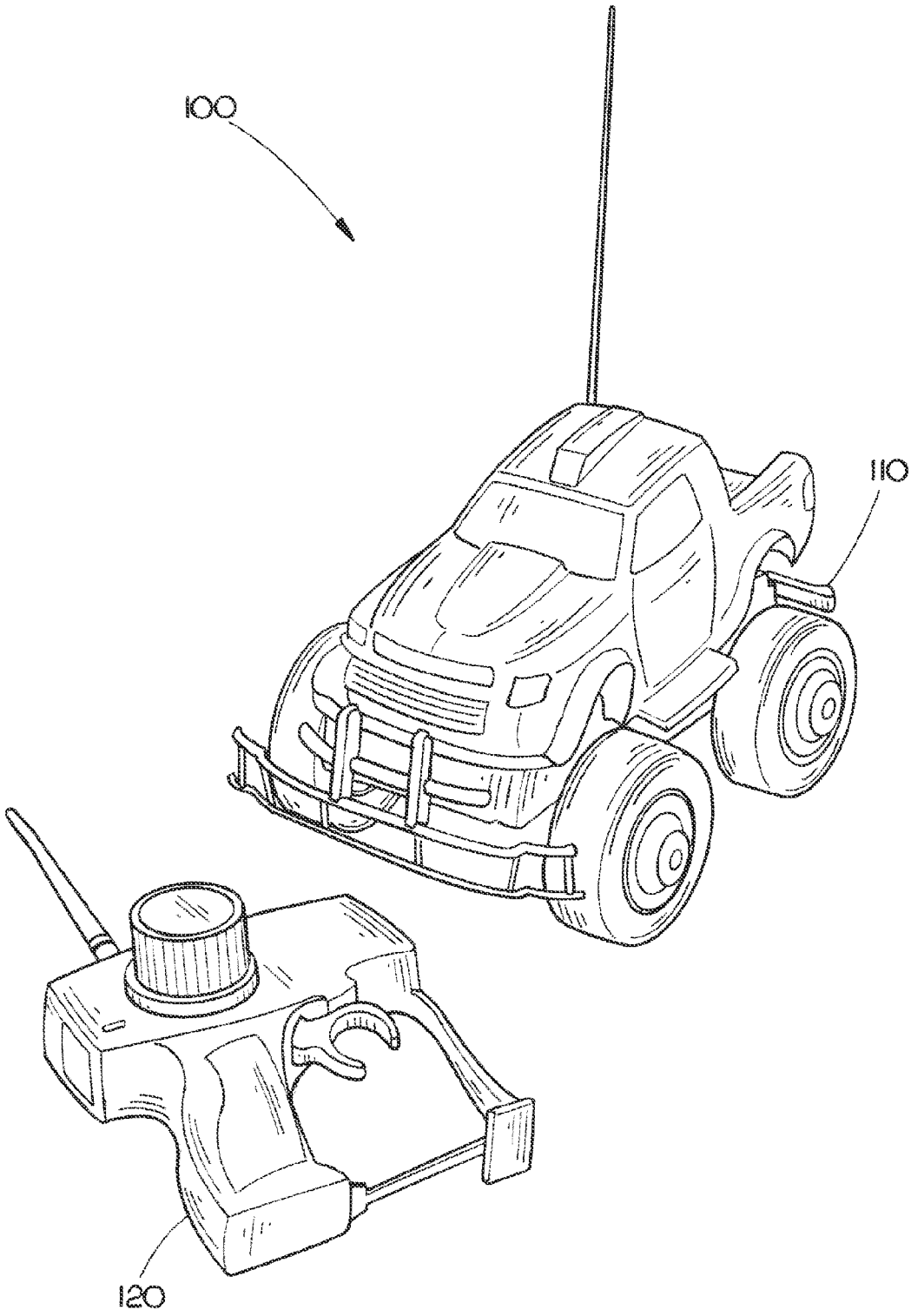
FIG. 1 (PRIOR ART)
FIG. 1 depicts a radio controlled system known in the art.
Figure 2:
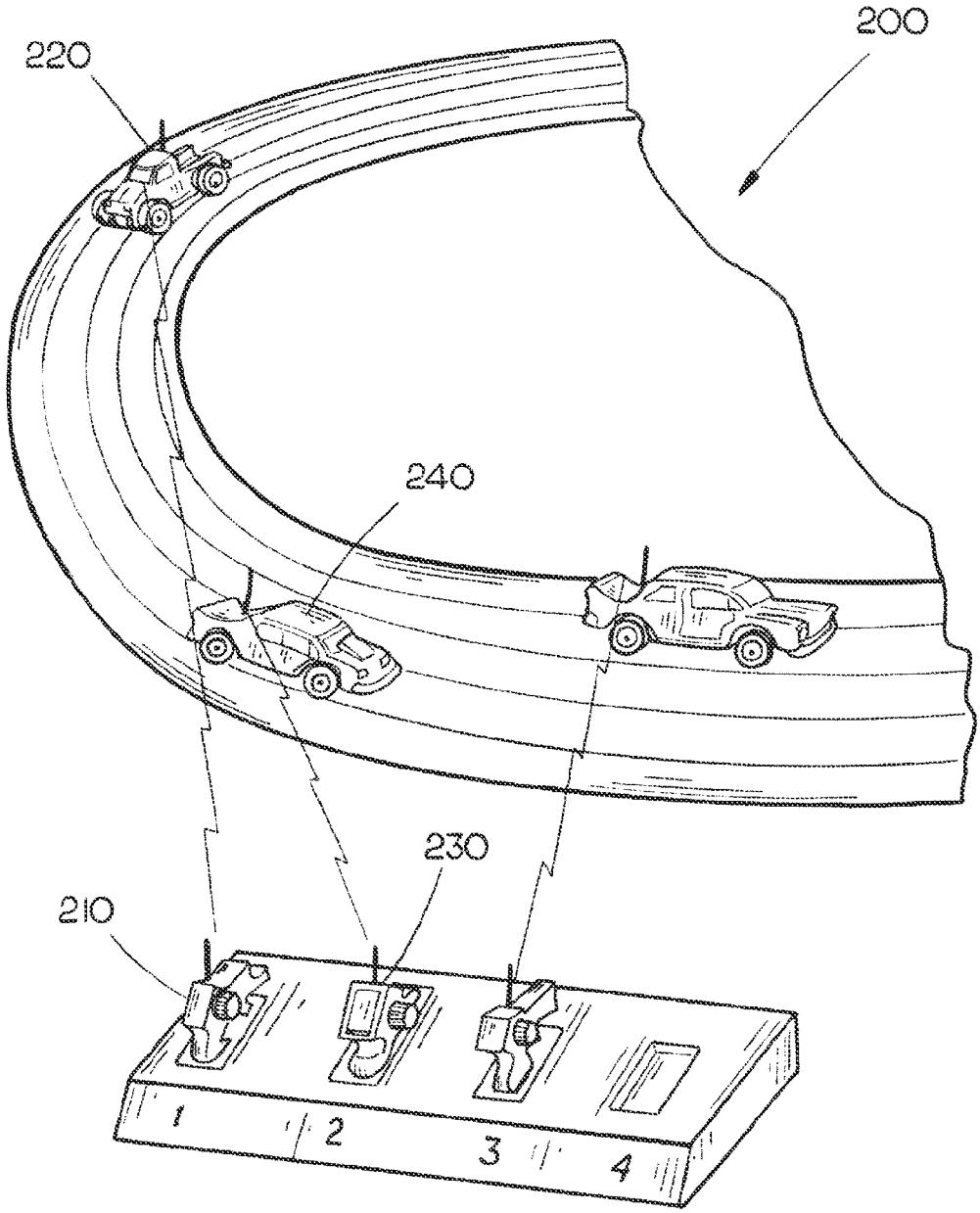
FIG. 2 depicts multiple radio controlled systems in the same geographical area.
Figure 3:
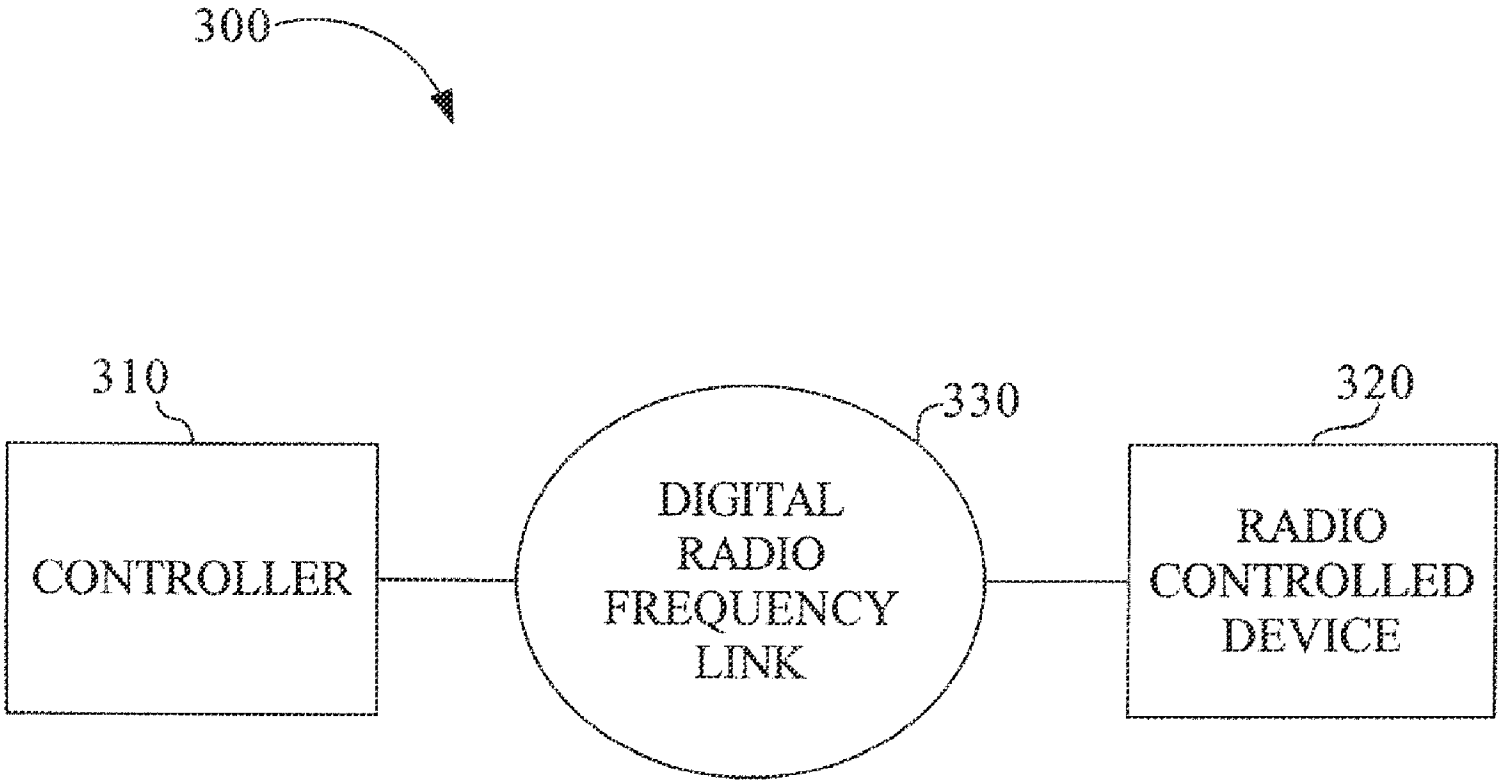
FIG. 3 depicts a system for controlling a radio control device in accordance with an embodiment of the present invention.

Referring to FIG. 3, a radio control system 300 for controlling a radio controlled device in accordance with an embodiment of the present invention is shown. System 300 may include a controller 310 and a radio controlled device 320. Controller 310 may be suitable for controlling a radio controlled device 320. Controller 310 may be coupled with a transmitter module in accordance with an embodiment of the present invention. Radio controlled device 320 may be coupled with a receiver module in accordance with an embodiment of the present invention. Radio controlled device 320 may be a terrestrial vehicle such as a car or motorcycle, a watercraft, such as a boat, an aircraft such as an airplane or helicopter, a military vehicle and the like. In a preferred embodiment, radio controlled device may be a model device, or a smaller scale version of a terrestrial vehicle, watercraft, aircraft, military vehicle and the like designed for use by hobbyists. A digital radio frequency link 330 may be provided between the controller 310 and the radio controlled device 320. In one embodiment of the invention, digital radio frequency link may employ spread spectrum modulation in accordance with the present invention. For example, spread spectrum modulation may be a form of direct sequence spread spectrum (DSSS) modulation optimized for control of radio controlled devices. RC system 300 may obtain a coding gain from utilizing DSSS modulation, however, it is contemplated that a system in accordance with the present invention may employ alternative spread spectrum modulation such as frequency hopping, time hopping, chirping or like spread spectrum modulation, including any hybrid or combination of any variety of spread spectrum modulation, orthogonal frequency division multiplexing, or the like.

In direct sequence spread spectrum, a stream of information for transmission is divided into small pieces, each of which is allocated to a frequency channel across the spectrum. A data signal at a point of transmission is combined with a higher data-rate bit sequence (also known as a chipping code) that divides the data according to a spreading ratio. The redundant chipping code helps the signal resist interference and also enables the original data to be recovered if data bits are damaged during transmission. For example, direct sequence spread spectrum may modulate each symbol of a digital signal by a binary pseudorandom sequence. Such a sequence may include N pulses or chips, whose duration Tc is equal to Ts/N. The modulated signal may have spectrum spread over a range N times wider than that of the original signal. On reception, demodulation may include correlating the signal with the sequence used on transmission to extract the information linked with the starting symbol.

It is contemplated that radio frequency link 330 may be a 1:1 network. A 1:1 network may include a one-way link between the transmitter of the controller and the receiver of the radio controlled device. Additionally, a 1:1 network may include a two-way link between the transmitter of the controller and the receiver of the radio controlled device. This may allow operation of a plurality of simultaneous networks, also 1:1 networks, within the same vicinity. This may be advantageous since use of radio controlled devices is done in groups whereby several radio controlled devices may be operating in the same geographical region.

Figure 4:
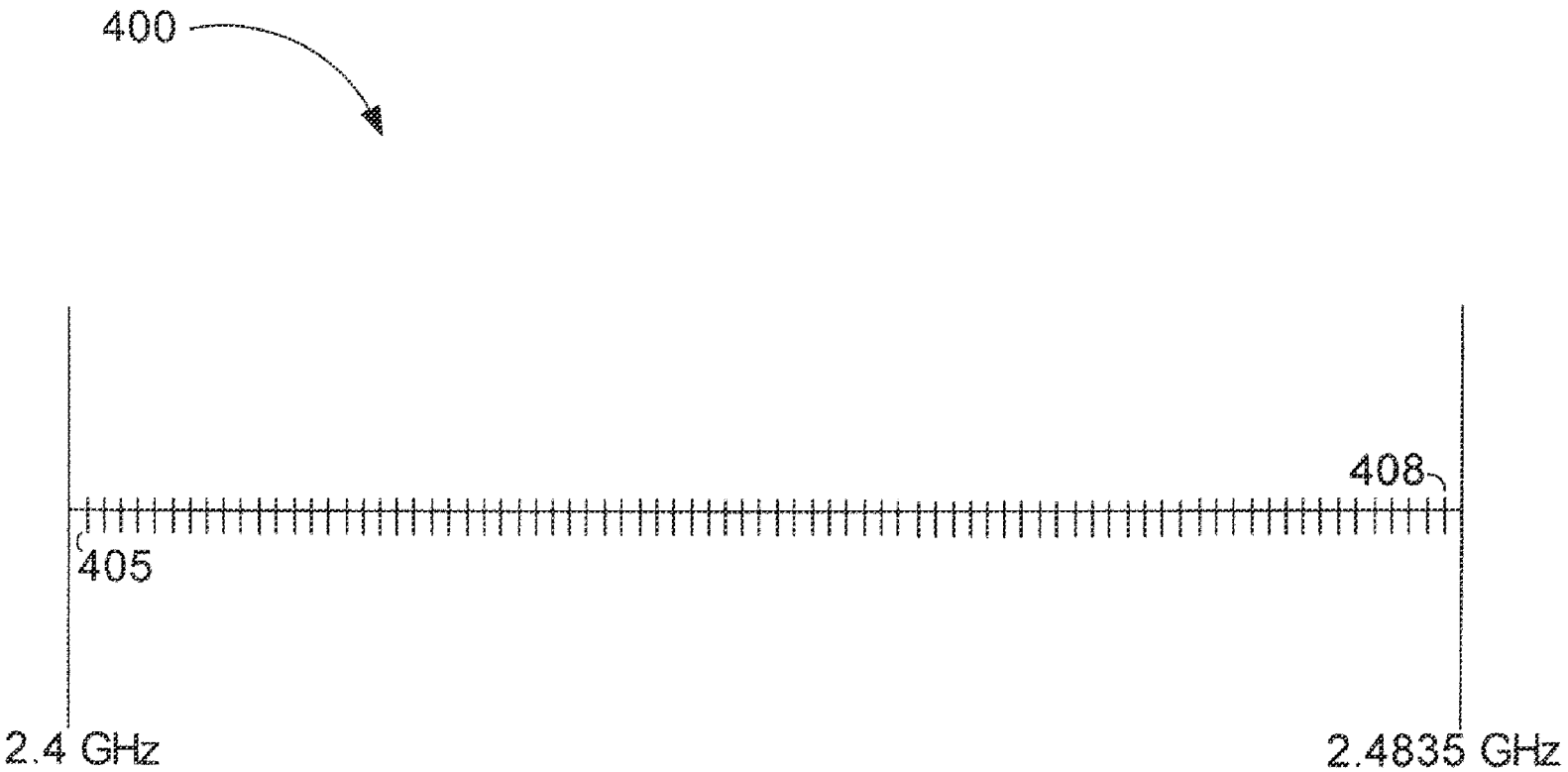
FIG. 4 depicts a diagram of a spectrum employed by a radio controlled system in accordance with an embodiment of the present invention.

Referring to FIG. 4, a diagram of a spectrum 400 employed by a radio controlled system in accordance with an embodiment of the present invention is shown. A radio controlled system may operate in the worldwide Instrument, Scientific, Medical (ISM) frequency band at 2.4 GHz-2.4835 GHz or higher. The frequency bands of 2.4 GHz to 2.4835 GHz may be out of the range of virtually all model-generated (motor and ESC noise) and conventional radio interference. Radio interference generally occurs in the 27 and 75 MHz bands. Operating at a higher frequency band may eliminate nearly all glitches and interference typically experienced by 27, 30, 35, 40, 50, 53, 72 and 75 MHz radios and all other usable radio control frequencies below 300 MHz, providing enhanced control of radio controlled devices. Furthermore, the radio controlled system may not have any interference with lap-counting systems often employed at race tracks for radio controlled devices. In a preferred embodiment, the 2.4 GHz band may be divided into 79 separate 1 MHz channels 405-408. It is further contemplated that a radio controlled system may operate in any other frequency band higher than 2.4 GHz, such as the 5.8 GHz band or the like.

A user-initiated process may bind a transceiver or receiver with a transmitter module. Once a transmitter module has been bound with a receiver module, the radio controlled system digitally encodes data and assigns data a unique frequency code. Data is then scattered across the frequency band in a pseudo-random pattern. A receiver may decipher only the data corresponding to a particular code to reconstruct the signal. Received data may include failsafe data, which may be transmitted from the transmitter module to the receiver module during binding. It is further contemplated that RF power may be reduced during a binding process, lowering the range to ensure that a transmitter module binds with a correct receiver module.

Figure 5:
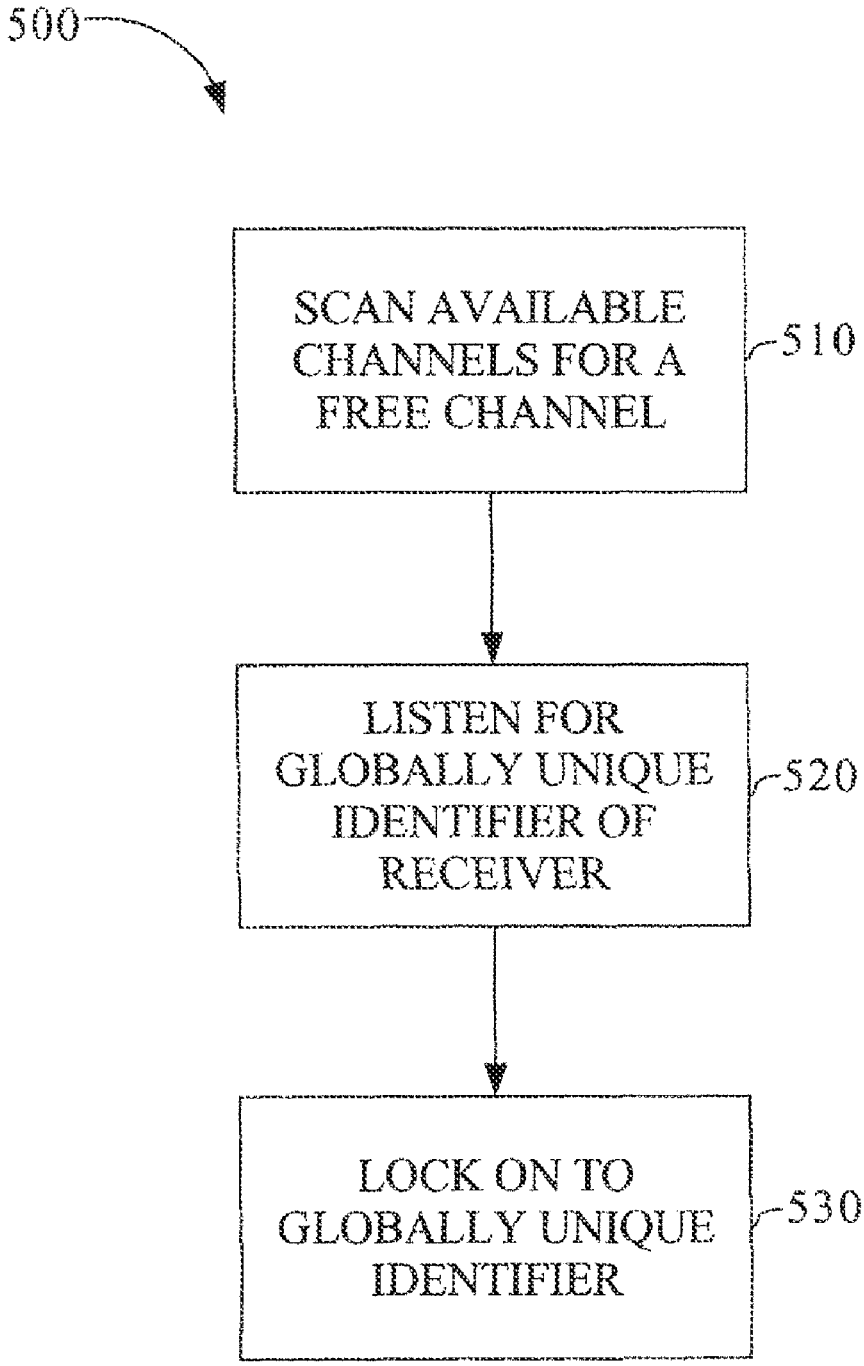
FIG. 5 depicts a flow chart of a process for selecting a channel for data transfer in accordance with an embodiment of the present invention.

Referring to FIG. 5, a flow chart of a process 500 for selecting a channel for data transfer in accordance with an embodiment of the present invention is shown. Radio controlled system transmitter modules may have a series of available channel frequencies for transmission. The number of distinct channel frequencies utilized by a selector in the series of channel frequencies may be a prime number. For example, radio controlled system may have at least 79 available channels on which to transmit in the 2.4 GHz band with each channel occupying 1 MHz. The 2.4 GHz band may be divided into 79 separate 1 MHz channels. This may allow up to 79 users to simultaneously operate radio controlled systems in accordance with the present invention with no interference. It should be understood that the ISM band is slightly modified in France, Spain and Japan but would not affect the operation of the present invention and necessarily would not depart from the scope and intent of the present invention.

Process 500 may begin by scanning the 79 available channels for a free channel 510. It is contemplated that modules of the present invention may be programmed with a globally unique identifier (GUID) before or after binding. For instance, a receiver module may be pre-programmed with a GUID. The transmitter module may listen for a GUID of a receiver 520, and lock on to the globally unique identifier 530. It is further contemplated that a transmitter module of the present invention may be pre-programmed with a globally unique identifier (GUID). When a free channel has been detected, a receiver of the present invention may detect a globally unique identifier of a transmitter to which the receiver has been bound. The receiver may lock on to the transmitter having the globally unique identifier.

Once a transmitter module of the present invention is bound with a specific receiver module of the present invention, the transmitter module and the receiver module may be locked. Thus, when the receiver module is locked to the transmitter module, the receiver or transceiver module may only recognize signals from that particular transmitter module. It is further contemplated that there may be over 4 billion possible GUID codes, substantially eliminating the possibility that a receiver module may mistake another signal source for its transmitter module. By employment of a receiver module or a transmitter module including a globally unique identifier (GUID), a requirement of conventional radio control systems of monitoring frequency usage may be eliminated.

If the channel spectrum is full, an $80^{th}$ system may not connect or cause any interference. The $80^{th}$ channel may go into "hold scan" until a channel is free. A selector may repeat a series of channel frequencies upon completion, and not use any channel more than once in each repetition of the series of channel frequencies.

In an embodiment of the invention, selection of an initial channel, step 510 of FIG. 5, may also be based upon a combination of signal strength and correlation. Upon a determination of available channels, an initial channel may be randomly calculated based on a time of a first event from a legacy transmitter. Code allocation and search pattern may also be calculated from a pseudo-random number derived from a GUID. A comb algorithm may be utilized to eliminate or reduce a media access uncertainty window.

It is contemplated that the radio controlled system of the present invention may be implemented with collision avoidance technology. This may prevent interference between other wireless devices such as wireless computers and telephones.

An advantageous aspect of the radio controlled system in accordance with an embodiment of the present invention may be method of data transmission. First, the radio controlled system may encode servo data individually within a sub-packet of a packet. Servo channel data may refer to the instructions for motors, such as servomotors which may include mechanical motors which operate to move a radio controlled device in a particular direction or at a particular speed. A radio controlled device such as a radio controlled car may include a plurality of servos. Instructions for each servo may be encoded within a sub-packet. For example a radio controlled device may include two servos, one coupled to the carburetor, and another to the steering mechanism. The servo connected to the carburetor may control the speed of the car and may also control braking. The second servo connected to the steering mechanism may control a direction of the front wheels of the radio controlled car. Encoding individual servo channel data may provide for lowest latency in transmission. This may be advantageous as it may allow more precise control over the radio controlled device as instructions may be received and processed in a more rapid fashion than conventional radio controlled systems. A globally unique identifier (different than GUID for receiver) may be included with a packet whereby a receiver in accordance with the present invention may synchronize and validate each sub-packet.

Each sub-packet may be decoded and processed to allow implementation of a particular instruction or set of instructions regarding a particular servomotor. If there is an error with one of the sub-packets, the other sub-packets may still be decoded. This may allow more secure and robust data transmission. Conventional radio control systems encode an entire packet whereby the entire packet may not be decoded if there is an error associated with the packet. Additionally, in a conventional receiver, the entire packet must be received before a receiver can begin producing servo pulses, substantially increasing transmission latency.

Conventional radio control systems also transmit only a portion of the operation information of a radio controlled device in individual packets. When a packet is lost, it is difficult to employ error correction to recover for the lost packet. Packets transmitted in accordance with the radio control system of the present invention may be sent via a streaming transmission whereby the packet includes the entire state of operation for the radio controlled device. If there is a lost packet, the next received packet may include the next entire state of operation for the radio controlled device. This further enhances the robustness of the transmission allowing full recovery of the entire state of operation of the radio controlled device.

Figure 6:
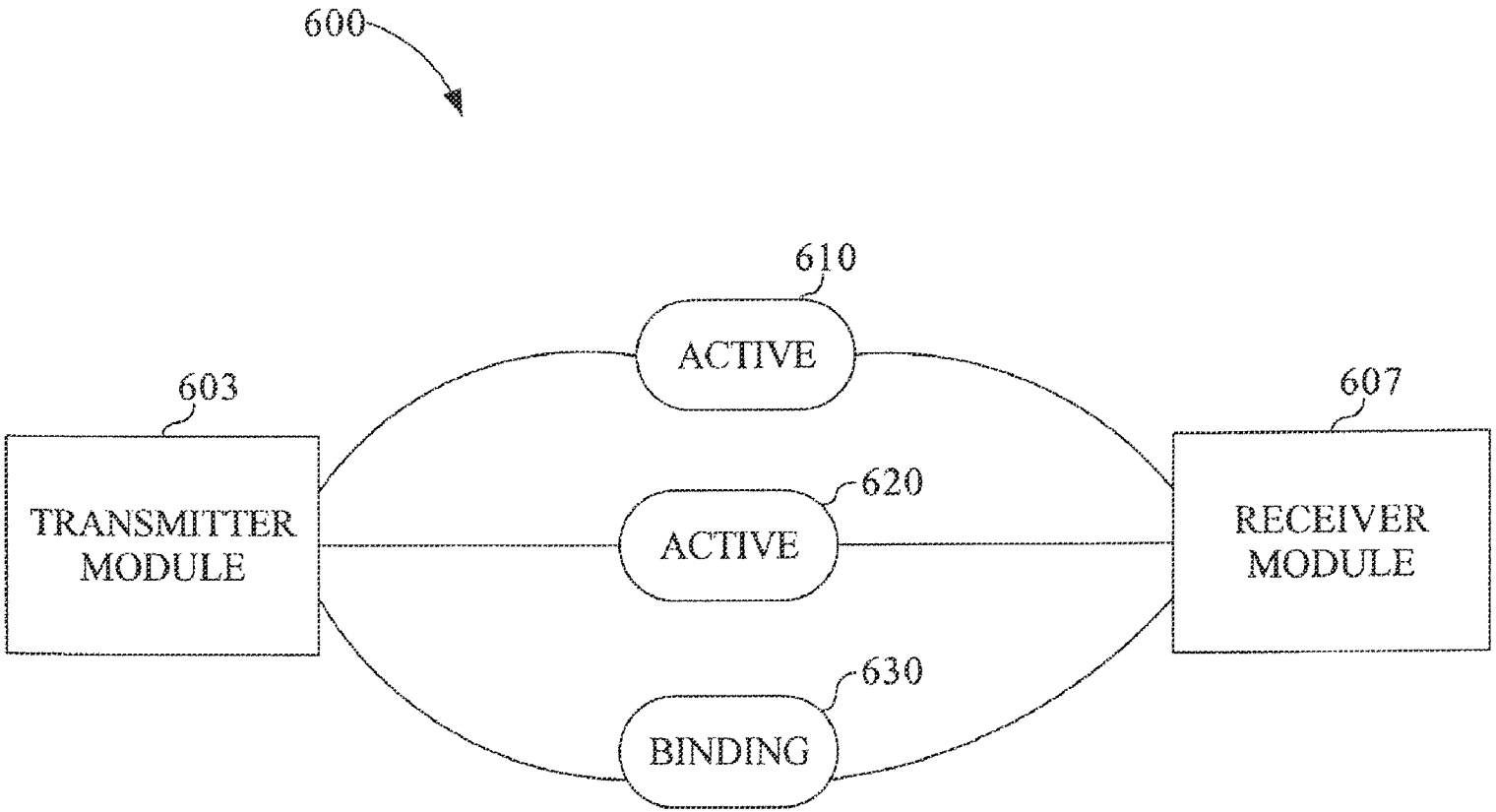
FIG. 6 depicts a block diagram of a radio controlled system for transmission of different types of packets in accordance with an embodiment of the present invention.

Referring to FIG. 6, a radio controlled system 600 for transmission of different types of packets in accordance with an embodiment of the present invention is shown. Radio controlled system may include a transmitter module 603 and a receiver module 607. In one embodiment of the invention, active packets 610, 620 may carry servo channel data and binding packets 630 may carry failsafe data. The radio controlled system in accordance with the present invention may utilize a unique PN code for binding, providing an improvement in robustness, as errors in the globally unique identifier and servo channel data may be corrected during a binding process. The packets of the present invention may not require length fields. Rather, a receiver module receiver may wait until a correlator fails to correlate for a determined number of chip periods.

In an embodiment of the invention, the radio controlled system may provide error detection and correction. Spreading codes may be utilized to detect the position of an error (bit that failed to correlate) within a globally unique identifier and servo data field. An error in the globally unique identifier may be corrected by applying an XOR function to the received globally unique identifier and the expected globally unique identifier with the position of the error.

Additionally, error detection may be provided by an encoding scheme in accordance with an embodiment of the present invention. A software linear feedback shift register (LFSR) may be utilized to encode servo data. LFSR may refer to a shift register whose input is the exclusive-or (XOR) of one or more outputs. Outputs that may influence input are generally known as taps. LFSRs may be implemented in hardware, and may be utilized in applications requiring rapid generation of a pseudo-random sequence. For example, LFSRs may be utilized in direct sequence spread spectrum radio applications such as the radio controlled system of the present invention. LFSR taps may be designed to catch 2 or more errors per channel. To minimize the chance of a false self correction, the positions of the errors may be dependent on each other. An initialization of the LFSR may be derived from a globally unique identifier, ensuring that if noise from another system misinforms a decoder of a receiver module, another system may be encoded with a foreign LFSR seed. If the position of the errors is known, a decoder may decode the channel data trying a 1 and then a 0 in the correct bit position until the error is corrected.

The radio controlled system of the present invention may operate according to real-time transmission or streaming. Substantially delayed or "lost" packets may have to be discarded at the destination because they have lost usefulness at the receiving end. Consequently, the radio controlled system of the present invention may employ interpolation of lost packets. Information from the packet previous to a lost packet may be used to reconstruct the missing packet. For example, if a previous packet included data for a ten degree left turn at a constant speed, it may be interpolated that the lost packet included data for a ten degree left turn at a constant speed. This may be advantageous as RC data packets represent continuous movement.

Conventional radio controlled device systems may not prevent loss of control of a radio controlled device upon signal loss. The radio controlled system of the present invention may employ failsafe technology in accordance with an embodiment of the invention. Advantageously, a radio controlled system in accordance with the present invention having failsafe technology may not require the installation of additional hardware, as is required by conventional radio controlled device systems. Rather, if the system experiences signal loss between the radio controlled device and controller, the radio controlled device may automatically enter a failsafe state. Failsafe instructions may be programmed to receiver during a binding process. Upon entering the failsafe state, the servos of a radio controlled device may be driven to a preset position. Failsafe instructions may be pre-programmed by system, or alternatively, failsafe instructions may be programmed by an operator as desired. For example, in the instance of a radio controlled car, a preset position of neutral may be pre-programmed, whereby the radio controlled car may glide to a stop in the event of signal loss. Alternatively, radio controlled system may receive instructions such as full brake, whereby a radio controlled car may brake to a complete stop in the event of signal loss.

In an alternative embodiment, only a throttle channel may be stored during a binding process. In the event of signal loss, a receiver module may drive a throttle to a preprogrammed failsafe position. Other channel data may be left in their last commanded positions. A receiver may also drive a throttle channel into failsafe position upon powering on of a radio controlled device.

Figure 7:
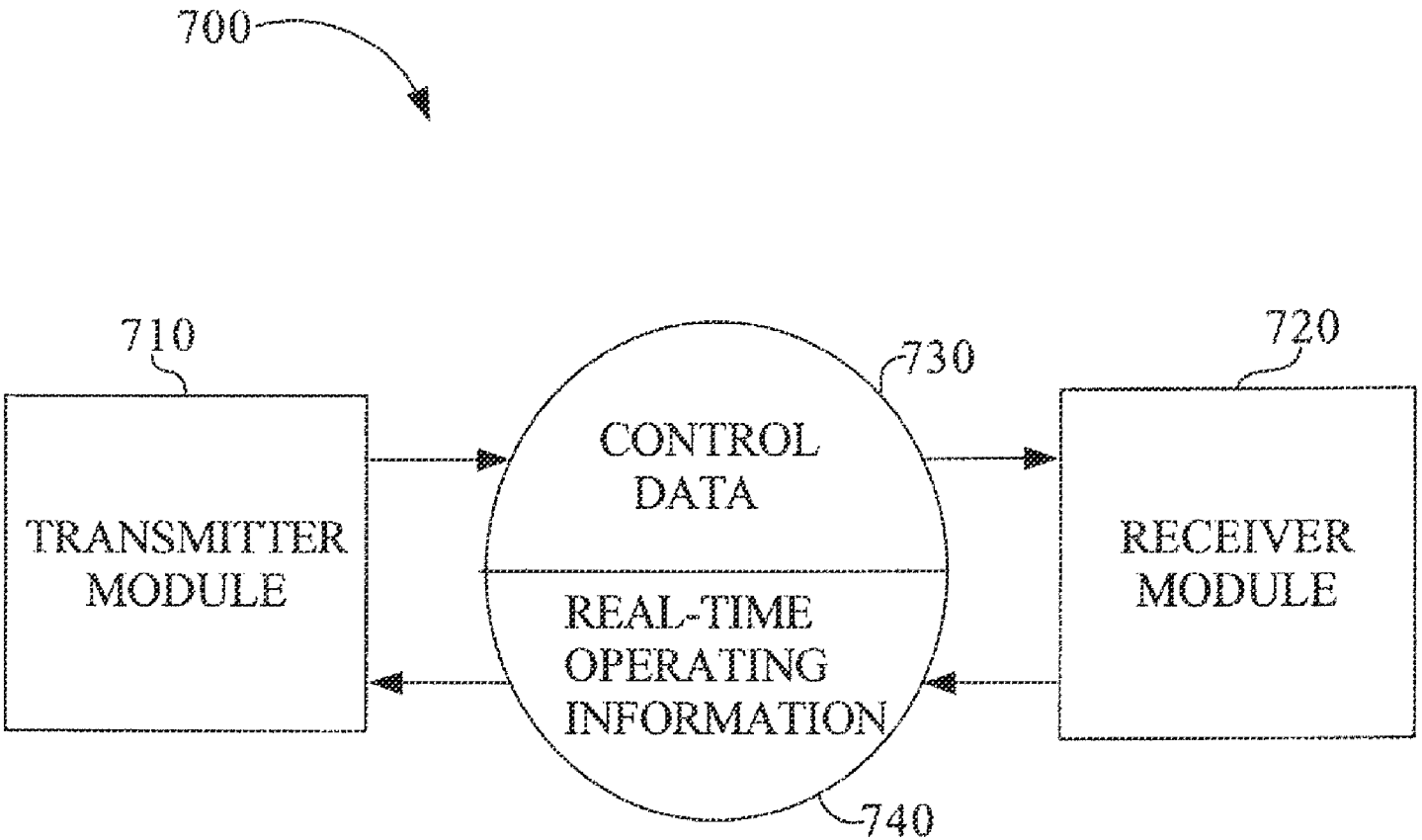
FIG. 7 depicts a telemetry system in accordance with an embodiment of the present invention.

A telemetry system may be employed with a radio controlled system in accordance with an embodiment of the present invention. A telemetry system in accordance with the present invention may be capable of sending data from the radio controlled device to the controller via the same digital radio frequency link used to control the radio controlled device. Referring to FIG. 7, an embodiment of a telemetry system 700 in accordance with the present invention is shown. Between a transmitter module 710 and receiver module 720 of the present invention, control data 730 may be sent from the transmitter module 710 to the receiver module 720 for controlling a radio control device. Control data 730 may include active packets and binding packets as shown in FIG. 6. Within the same digital radio frequency link, real-time operating information 740 may be passed from the receiver module 720 to the transmitter module 710.

A telemetry system of the present invention may be a "plug in" telemetry module that plugs into receiver, sensors, handheld readers, control units and the like. Telemetry data may be recorded and viewed on an information processing device such as a personal computer. A telemetry system in accordance with the present invention may comprise a telemeter, a transmitter module and a receiver module. Telemeter may operate with receiver module wherein diagnostic messages containing information about a radio controlled device may be transmitted from the receiver module to the transmitter module. A programmable indicator, such as a tone, may alert the user of certain conditions such as maximum temperature or signal strength.

Figure 8:
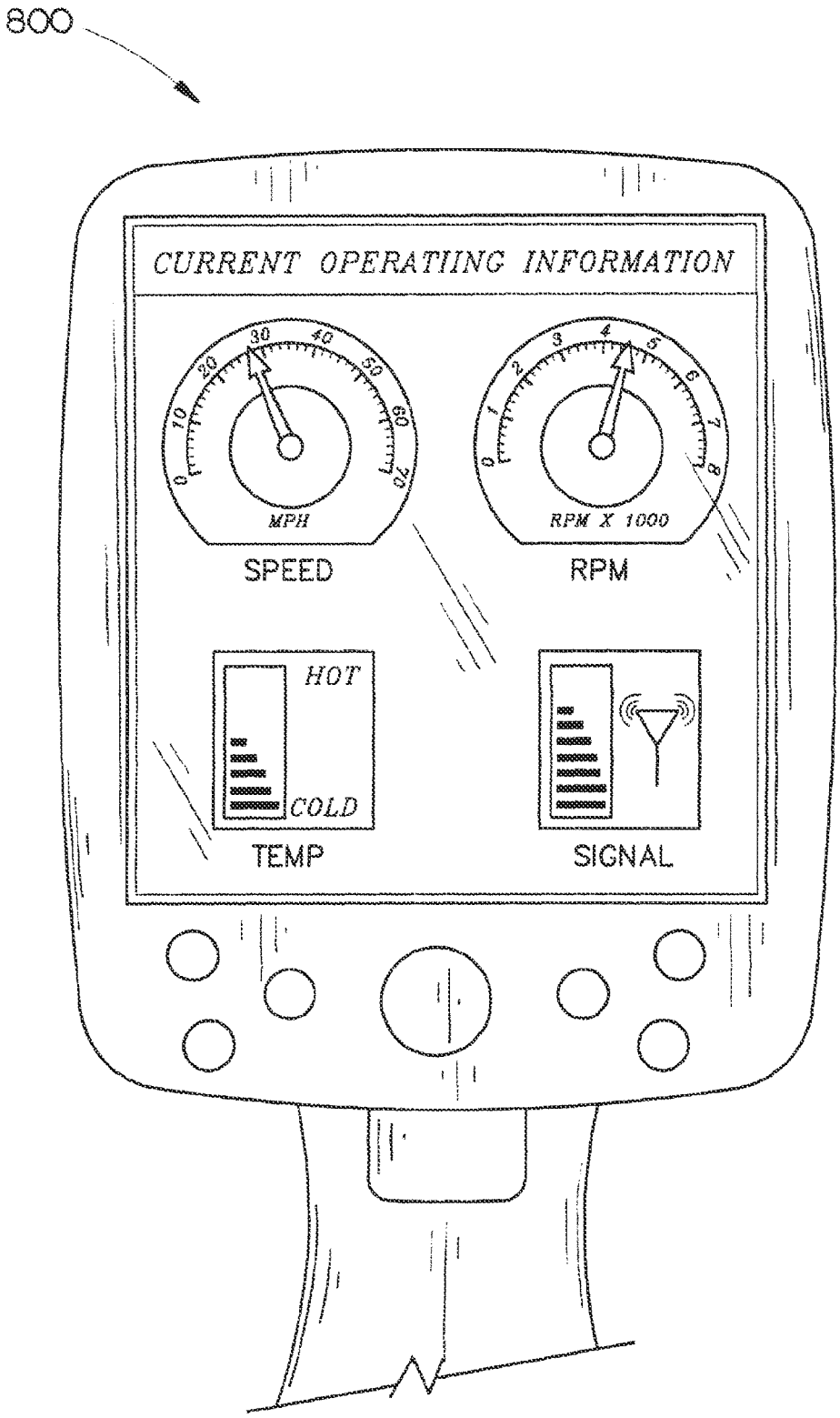
FIG. 8 depicts a graphical interface viewable upon a visual display regarding real-time radio controlled device data.

In an embodiment of the invention, real-time operating information 740 may be presented to the user for his/her review to aid the user in controlling the radio controlled device. For example, real-time operating information may include engine temperature, engine revolutions per minute, speed, battery voltage, signal strength, individual lap time and like diagnostic information. Diagnostic information may be presented as part of a visual display. System may also include an accelerometer, fuel measurement such as by electronic resistance, traction control, automatic braking and the like. Referring to FIG. 8, a graphical interface 800 viewable upon a visual display regarding real-time radio controlled device data is shown. A visual display may be added to a controller. Additionally, some controllers may include a visual display. Visual display may be a liquid crystal display or the like.

In an advantageous aspect of the present invention, back-channel telemetry may be utilized for force-feedback in the radio controlled system. It is contemplated that real-time operating information may be sent to the transmitter module from the receiver module. This real-time operating information may be employed by a controller to aid the user experience. For example, force-feedback may be provided to a control input of a controller, such as an elevator stick of a controller, whereby the elevator stick is harder to pull back when a radio controlled airplane is on a steep dive. Additionally, information such as groundspeed may be determined and sent to controller. Controller steering rate may be adjusted proportionally to the groundspeed data.

Figure 9:
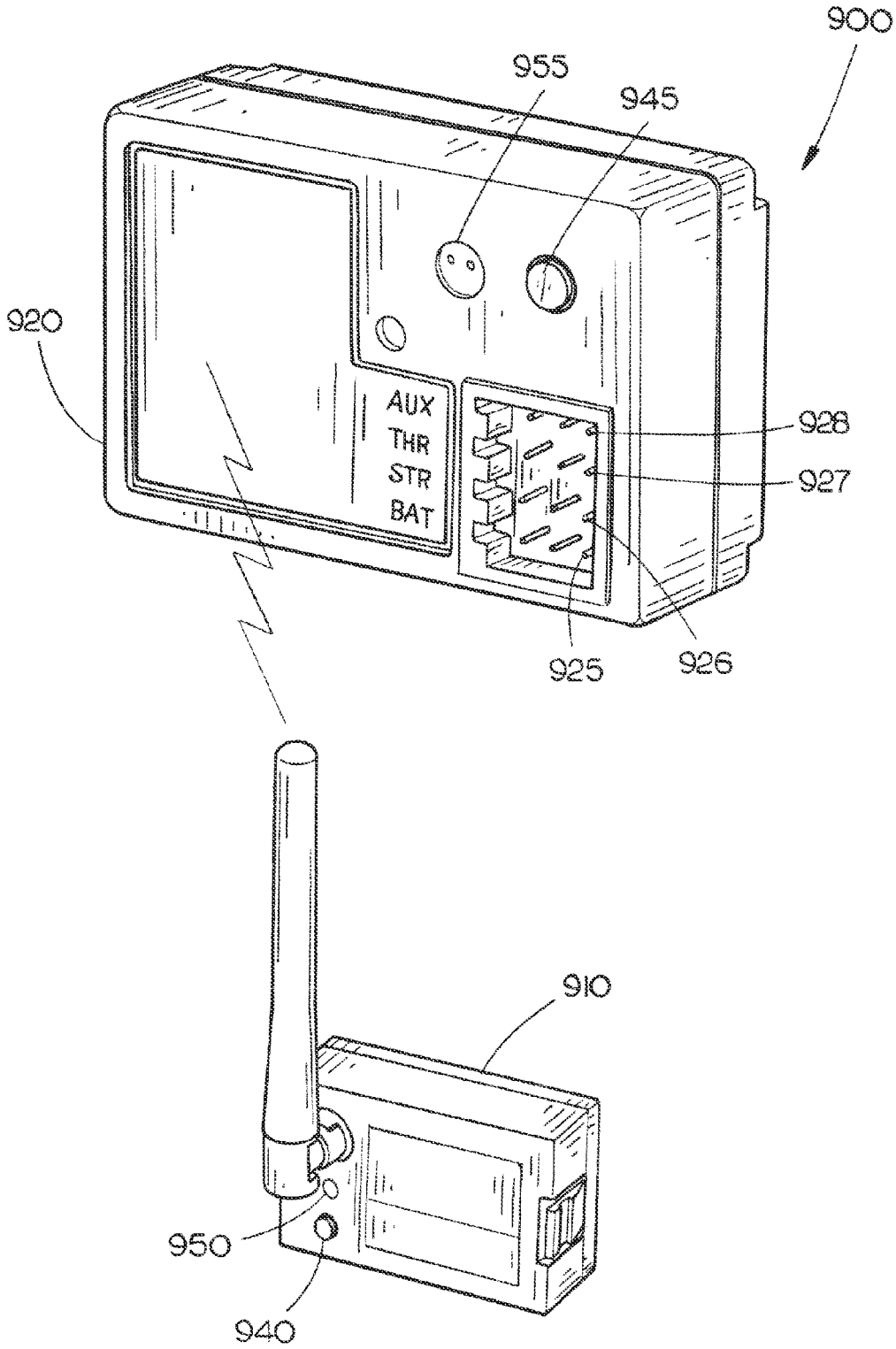
FIG. 9 depicts an implementation of a radio controlled system including a transmitter module and receiver module in accordance with an embodiment of the present invention.

Referring to FIG. 9, an implementation of a radio controlled system 900 including a transmitter module 910 and receiver module 920 in accordance with an embodiment of the present invention is shown. It is contemplated that transmitter module 910 may be coupled with a conventional controller and the receiver module 920 may be coupled with a radio controlled device, thus providing an add-on capability to an existing radio controlled system. For example, the radio controlled system including transmitter module 910 and receiver module 920 may be available for modular-based three-channel systems. Advantageously, transmitter module 910 may include a plurality of apertures suitable for receiving pins for coupling with a controller. In one embodiment of the present invention, transmitter module may include an antenna 930. In a preferred embodiment, antenna may be an integrated 2.4 GHz folded dipole antenna. An integrated antenna 930 may remove a requirement of mounting an antenna to an existing controller. Antenna 930 may also be rotated in two planes to provide optimal transmission capability.

In an embodiment of the invention, receiver module 920 may include several ports 925-928. A first port 925 may refer to battery and telemetry options. A second port 926 may refer to a channel for steering. A third port 927 may refer to a channel for throttle. A fourth port 928 may refer to an auxiliary channel or personal transponder. It is contemplated that ports 925-928 may be suitable for receiving existing connectors from a conventional radio controlled device without the requirement of additional hardware, interfaces and the like.

Figure 10B:
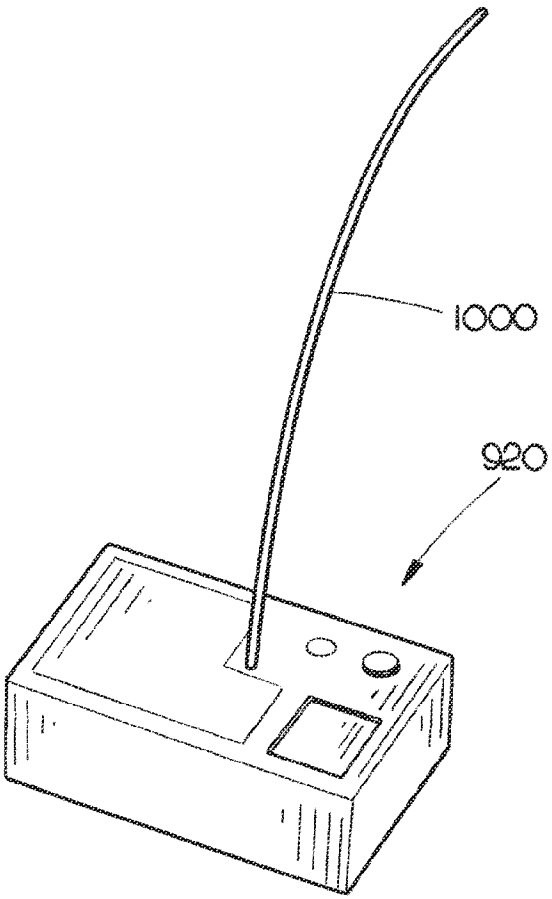
FIGS. 10A and 10B depict a receiver module in accordance with embodiments of the present invention.
Figure 10A:
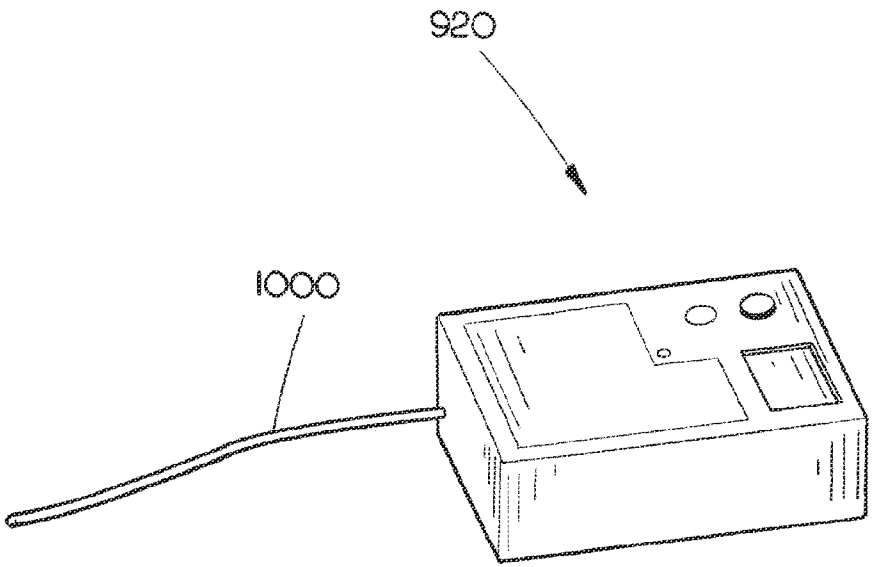

Transmitter module 910 and receiver module 920 may both include a binding button 940, 945 and a visible alert 950, 955 such as a light emitting diode. The visible alert 950, 955 may be advantageous in the binding process performed to program the receiver module 920 to a specific transmitter module 910. Referring to FIGS. 10A and 10B, embodiments of a receiver module 920 are shown. Receiver module 920 may include an antenna 1000 for enhanced reception of commands. The placement of antenna 1000 may be varied depending upon the intended position of mounting within a radio controlled device. In an advantageous aspect of the present invention, receiver antenna may be substantially vertically positioned, or may be coupled vertically to the receiver and bent to horizontal. Also, the length of the antenna may be reduced without compromising performance.

It is contemplated that transmitter module 910 may produce an approximately 2.4 GHz signal transmitted by a voltage controlled oscillator (VCO) and a phase-locked loop (PLL) feedback circuit whereby digital information may be injected into the feedback circuit. It is contemplated that transceiver may operate according to Pulse Position Modulation (PPM). Receiver module 920 may be capable of receiving, detecting, demodulating, decoding and implementing commands received from transmitter module 910. In a preferred embodiment, receiver is a multi-channel receiver.

Figure 11:
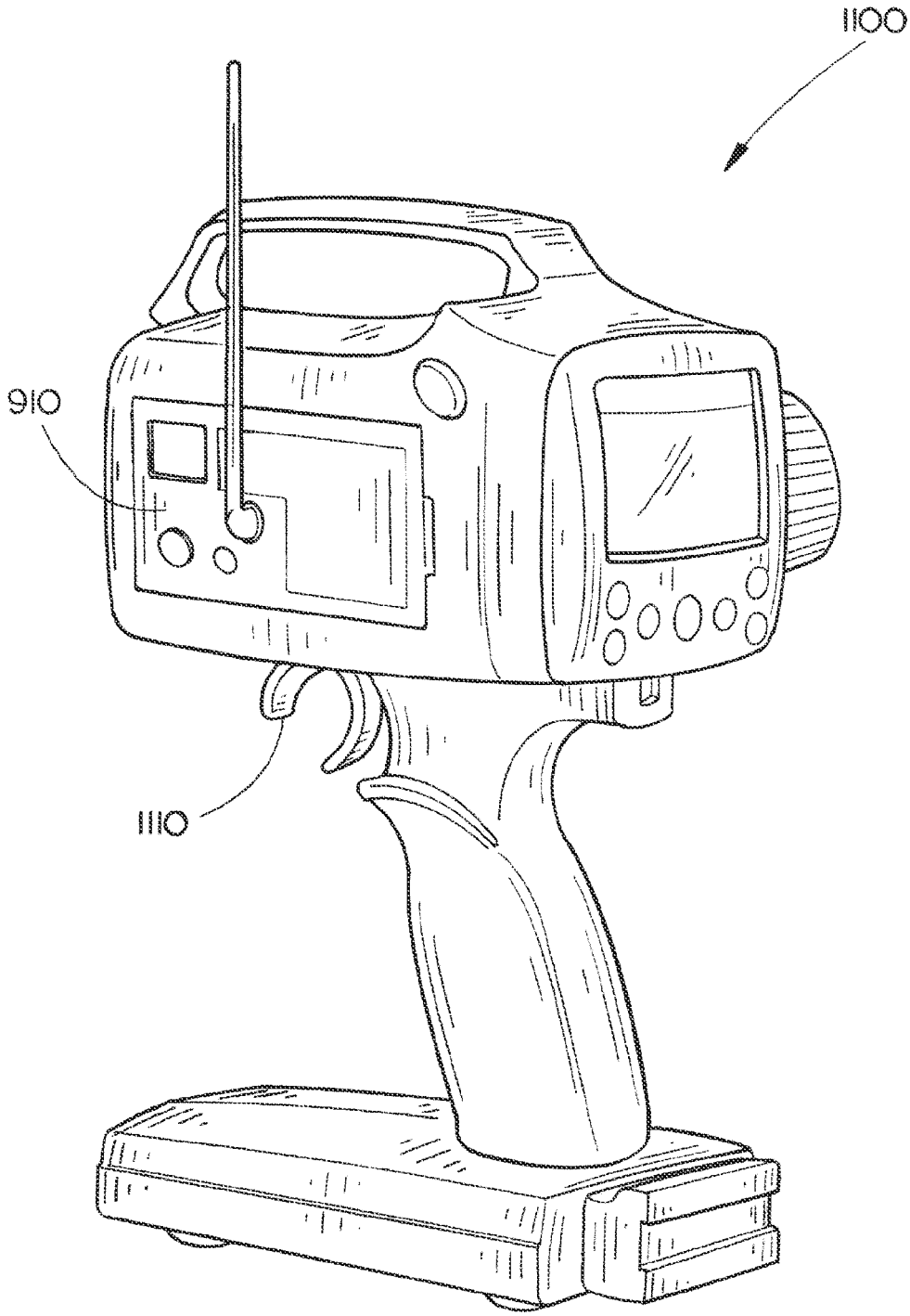
FIG. 11 depicts a controller including a transmitter module in accordance with an embodiment of the present invention.

Referring to FIG. 11, a controller 1100 including a transmitter module 910 in accordance with an embodiment of the present invention is shown. Controller 1100 may include one or more controls, such as a trigger button 1110, for receiving manual inputs representing a user's commands. The user's commands may be translated into data which is received by the transmitter module 910, modulated and sent to a receiver module of a radio controlled device. It is contemplated that transmitter module 910 may be suitable for mounting within an existing receptacle of controller 1100 whereby the apertures of the transmitter module 910 may receive pins of a controller for electrically coupling the transmitter module 910 with the controller 1100.

In an advantageous aspect of the present invention, a transmitter module 910 in accordance with an embodiment of the present invention may be added to a conventional controller 1100 such as a JR R-1 and R-1 Pro, Airtronics M8, KO Propo EX-10 Helios, Futaba 3PK, Hitec Aggressor CRX and the like. This may allow the user to employ a radio controlled system in accordance with the present invention without the requirement of additional purchases of another controller and radio controlled device.

Figure 12:
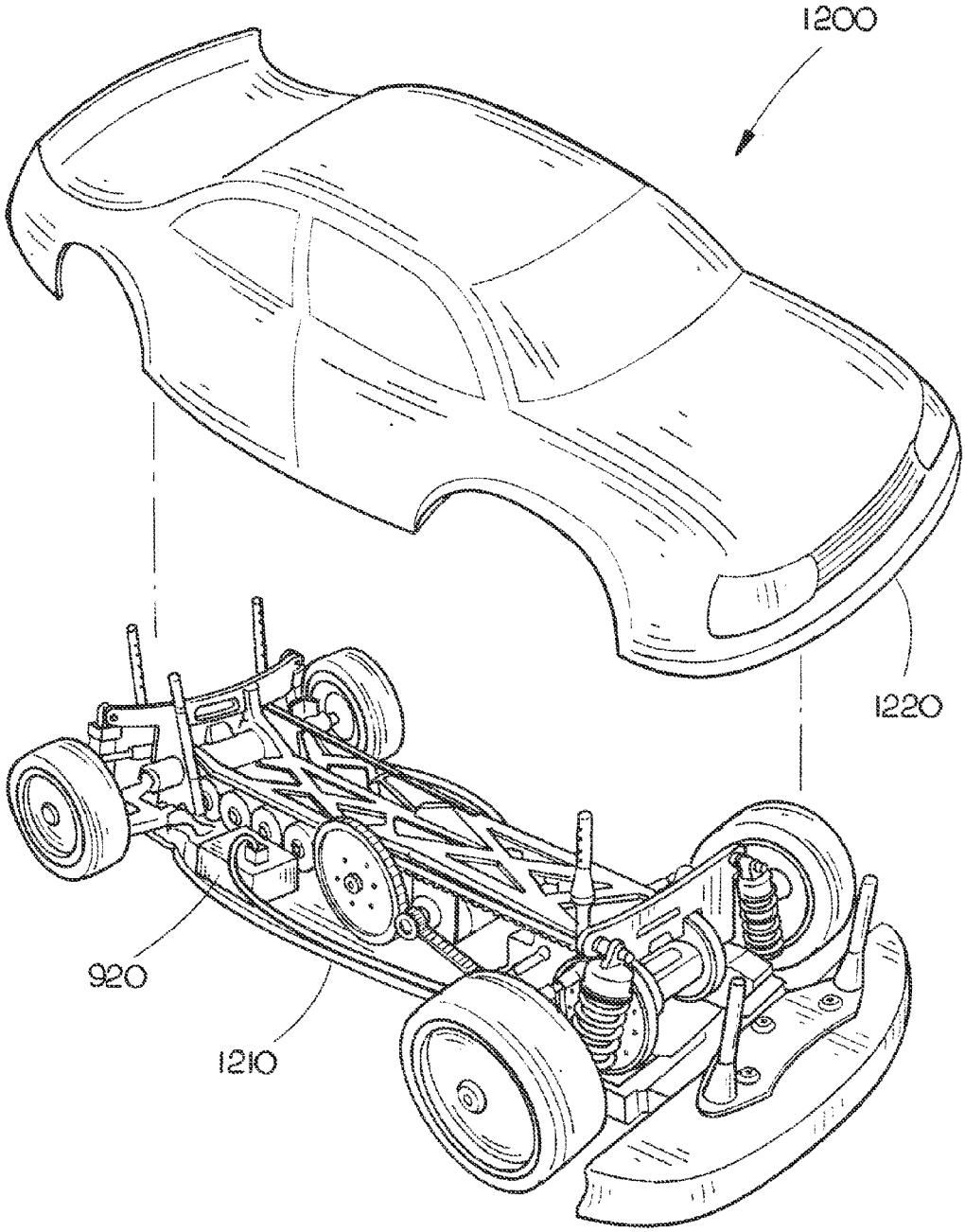
FIG. 12 depicts a radio controlled vehicle implemented with a receiver module in accordance with an embodiment of the present invention.

Referring generally to FIG. 12, a radio controlled vehicle 1200 implemented with a receiver module 920 in accordance with an embodiment of the present invention is shown. Radio controlled vehicle 1200 may comprise a model car chassis unit and power unit. Receiver module 920 may be easily mounted to the chassis unit and coupled to the integrated circuitry which processes the data. Radio controlled car 1200 may be battery powered, engine powered, solar powered, or the like. In an embodiment of the invention, radio controlled car 1200 may comprise a frame 1210 having front wheels and back wheels mounted thereon, the frame being coupled to a car body such as a casing 1220. The body of the car may be comprised of a lower chassis that holds mechanical and electronic components, and a shell coupled to the chassis. In an alternative embodiment of the invention, radio controlled vehicle may be a model boat, airplane, helicopter or a like RC device.

Decoded signal output from the receiver module 920 may be distributed to each servo of a radio controlled device 1200. Each servo is driven by a signal to control the direction, speed or other such characteristics of a radio controlled device 1200. A sensor for indicating rotational position of the output shaft may be connected to the output shaft of a servo. The rotational angle of the output shaft of the servo may be substantially proportional to the operation angle of the joystick.

Figure 13:
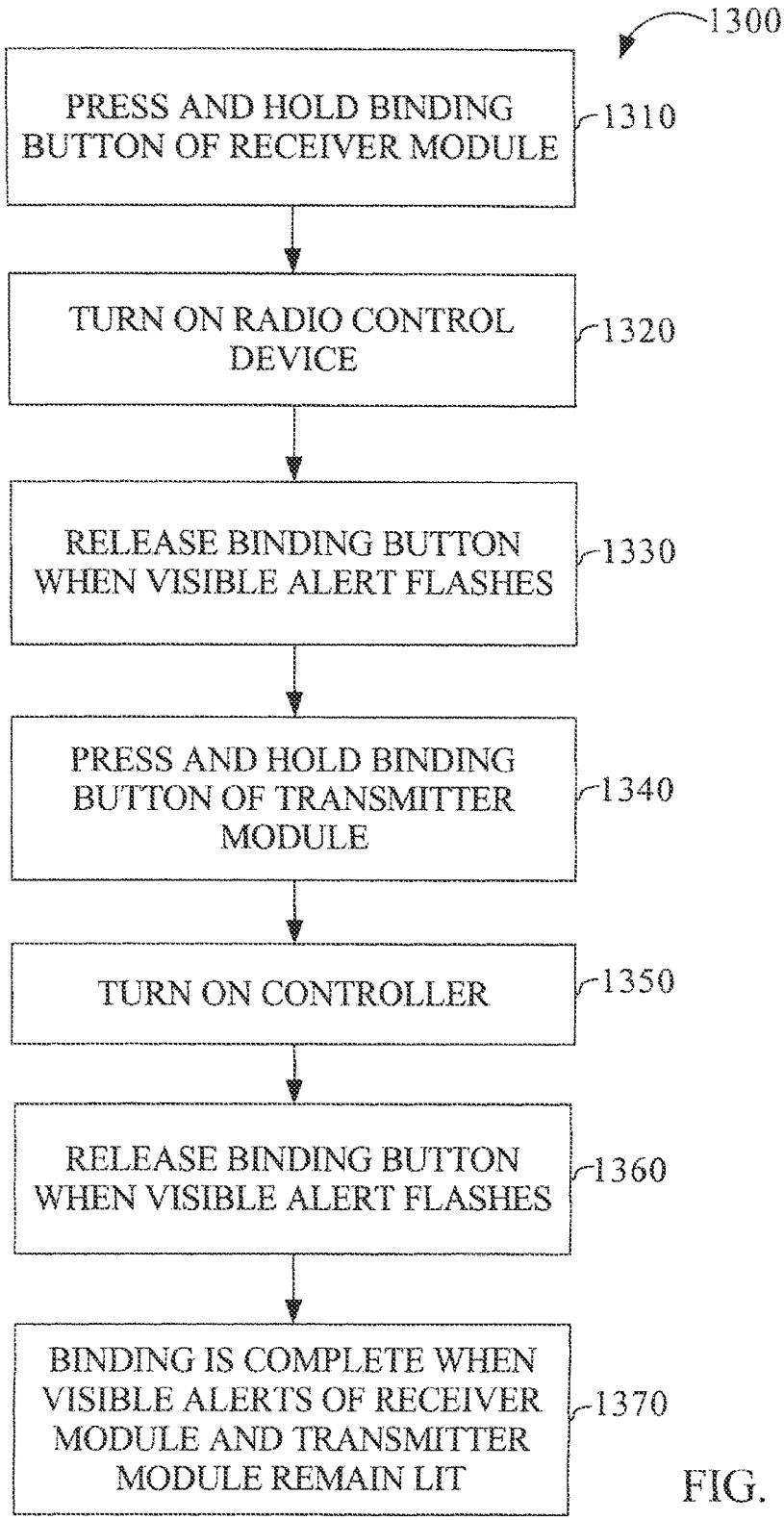
FIG. 13 depicts a flow chart of a process for binding the receiver module to a specific transmitter module.

After installation of the transmitter module 910 within controller 1100 and receiver module 920 within radio controlled device 1200, the receiver module 920 may be bound to transmitter module 910 for optimal operation. Referring to FIG. 13, a flow chart of a process 1300 for binding the receiver module to a specific transmitter module is shown. The process may begin following installation of the transmitter module within a controller and installation of the receiver module within a radio controlled device. With the radio controlled device off, a binding button of the receiver module may be depressed and held in a substantially depressed position for a period of time 1310. For example, binding button may be depressed for 3-5 seconds. The radio controlled device may be turned on 1320, when the visible alert of the receiver module flashes, the binding button may be released 1330. With the controller off, a binding button of the transmitter module may be depressed and held in a substantially depressed position for a period of time 1340. The controller may be turned on 1350, when the visible alert of the transmitter module flashes, the binding button may be released 1360. When the visible alerts of the transmitter module and the receiver module stop flashing and remain lit, binding may be complete 1370.

During the binding process, the radio frequency (RF) power may be reduced. This may protect the receiver module from accidentally binding to another system in the area. Additionally, fail safe data may be transferred from the transmitter module to the receiver module during the binding process. This may ensure the servo failsafe positions are set. Transferring the failsafe data during binding may be advantageous for controllers that operate in PPM mode.

Figure 14:
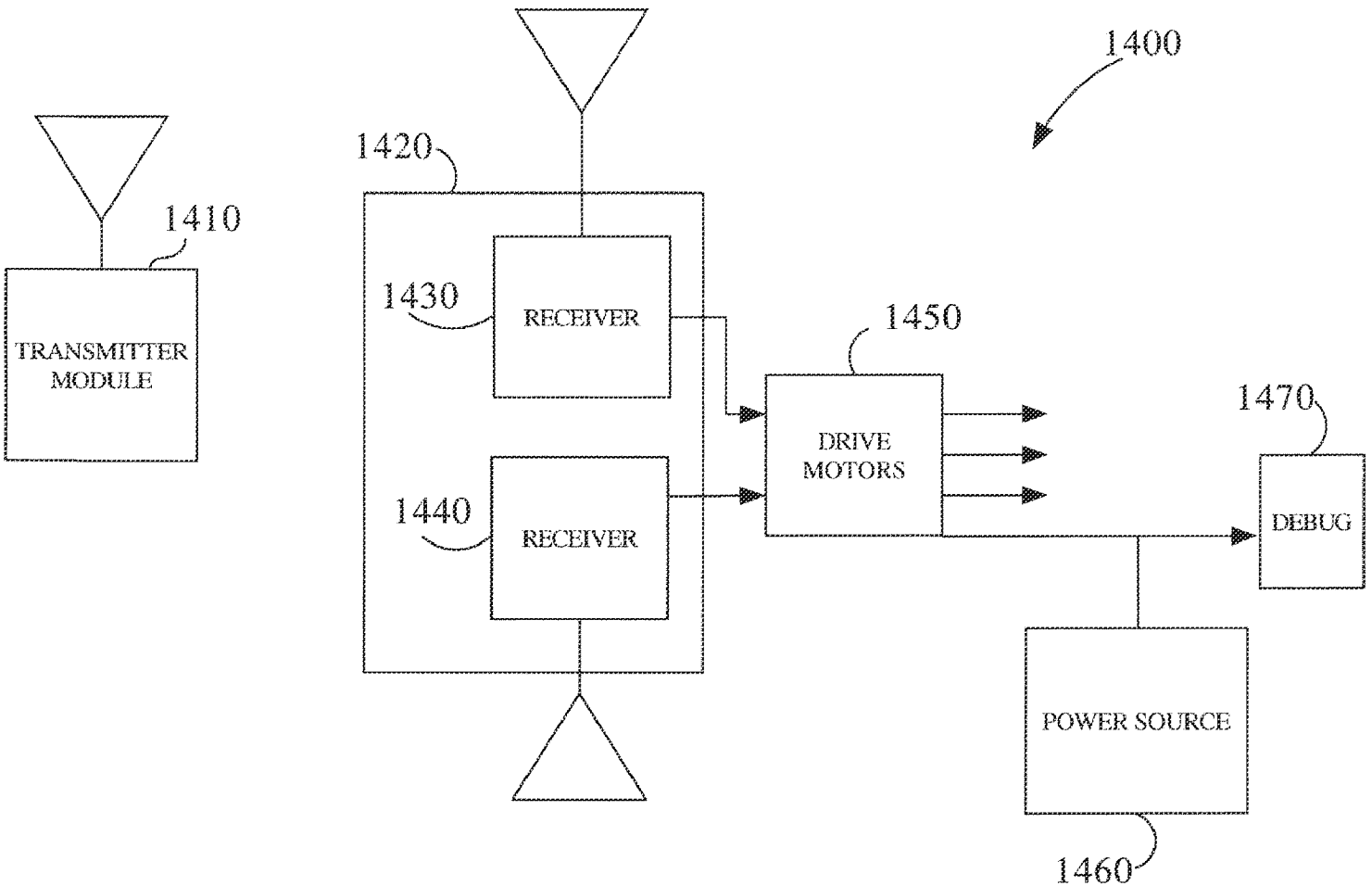
FIG. 14 depicts a system for controlling a radio control device in accordance with an embodiment of the present invention.

Referring to FIG. 14, a block diagram of an RC system 1400 in accordance with the present invention is shown. RC system 1400 may be operable with a radio controlled aircraft system in one embodiment of the invention, however, it is contemplated that radio controlled system 1400 may operate with any type of radio controlled device. Radio control system 1400 may include a transmitter module 1410, similarly operable within an aircraft controller such as transmitter module 910 within controller 1100 of FIG. 11, capable of transmitting two or more discrete frequencies. RC system receiver module 1420, similarly operable within a radio controlled aircraft such as receiver module 920 within radio controlled car 1200 of FIG. 12, may include at least two receivers 1430, 1440, and may be further coupled to a plurality of drive motors 1450 which operate to move a radio controlled device in a particular direction and at a particular speed based upon control instructions received from the transmitter module via a spread spectrum modulated digital radio frequency link. Drive motors 1450 may be electronically coupled to a power source 1460, such as a battery and a debug port 1470. While two receivers 1430, 1440 are shown, it is contemplated that three or more receivers may be employed in the RC aircraft system 1400 without departing from the scope and intent of the present invention. Additionally, each receiver 1430, 1440 may include a discrete antenna to aid in path diversity.

Radio control system 1400, such as a RC aircraft system may include a multi channel transmitter module 1410. Transmitter module 1410 may be operable in the 2.4 GHz frequency band, and may employ a digital radio frequency link. It is further contemplated that a radio controlled system 1400 may operate in any other frequency band higher than 2.4 GHz, such as the 5.8 GHz band or the like. In one embodiment of the invention, digital radio frequency link may employ spread spectrum modulation in accordance with the present invention. For example, spread spectrum modulation may be a form of direct sequence spread spectrum (DSSS) modulation optimized for control of radio controlled devices. An RC aircraft system 1400 may obtain a coding gain from utilizing DSSS modulation, however, it is contemplated that a system in accordance with the present invention may employ alternative spread spectrum modulation such as frequency hopping, time hopping, chirping or like spread spectrum modulation, including any hybrid or combination of any variety of spread spectrum modulation, orthogonal frequency division multiplexing, or the like. Transmitter module 1410 may be capable of transmitting two or more discrete frequencies to transmit data redundantly in two or more time periods. For example, transmitter module 1410 may acquire two or more discrete 1 MHz channels. 1 MHz channels may be a minimum distance from additional 2.4 GHz radiators, such as additional RC aircraft devices and the like.

It is contemplated that transmitter module 1410 may be capable of transmitting data via two or more diverse frequency transmission methods. Diversity may be achieved by the existence of multiple copies of signal information. Information may be replicated by various diversity techniques to provide a receiver with optimal spatial signal processing regardless of temporal signal characteristics. Diversity may be made available to a receiver by the structure of a transmitted signal or receiver architecture. In a preferred embodiment, a system in accordance with the present invention may utilize one or more of frequency, time and path diversity to reduce or substantially eliminate multipath fading and intersymbol interference. It is further contemplated that transmitter module may employ alternative diversity schemes suitable for recovering transmitted data at or more receivers including antenna diversity, polarization diversity or like diversity schemes.

An RC aircraft system in accordance with the present invention may employ frequency diversity, wherein the same signal may be spread over a larger frequency bandwidth. Signal spread may expand a signal beyond the coherence bandwidth of a channel. A channel may be frequency selective and may decrease the probability of signal fading along an entire bandwidth. For example, an assumption may be made that signal bandwidth is larger than coherence bandwidth, resulting in delay spread that is larger than chip length. A received signal may be correlated with differently delayed transmissions of the spreading sequence, allowing for the recombination of separated signal energy of different paths.

Alternatively, frequency diversity may be achieved by signals transmitted on two or more independent fading carrier frequencies. Carrier frequencies may be independent if the distance between them exceeds a certain minimum distance. Any reflections from the ionosphere causing phase cancellation on one frequency would have a different phase on the other frequency and therefore not cancel. Frequency diversity may exploits the change in the multipath fading environment when the carrier frequency changes. If signals transmitted by transmitter module are a sufficient distance apart, such as several times the coherence bandwidth, fading corresponding to each frequency may be uncorrelated. By establishing two or more parallel bearers at different frequencies, a receiver module may determine which bearer to use.

An RC aircraft system in accordance with the present invention may further employ time diversity techniques to substantially eliminate multi-path and intersymbol fading. Time diversity utilizes transmissions wherein signals or data packets representing identical data are transmitted over the same channel at two or more time intervals. Synchronous transmission of data across two or more time intervals with a time delay between each transmission may be particularly useful for a radio control system subject to burst error conditions, and at intervals adjusted to be longer than an error burst. The same data may be transmitted over a channel at different time intervals, resulting in uncorrelated received signals if the time difference exceeds a certain minimum time interval. For example, if channel errors may be affected by fast fading, a time separation between data transmissions may be at least one mean fade duration. A received data bit may be compared with a corresponding delayed data bit. In such systems, synchronous operation may be required in order to identify each bit. A change in data rate may require a corresponding change in synchronous clocking in the transmitter and receiver apparatus. If a difference is observed between bits as a result of a comparison of bits, an error is identified. When an error is identified, one of the data bits, for example the earlier transmitted data bit, is the one selected for actual use. Alternatively, time diversity may divide data in bits time, with a portion of each bit being transmitted on each frequency. A receiver that does not receive a correct packet from several transmissions may utilize packet combining techniques such as bit for bit majority voting to determine a transmitted packet.

An RC aircraft system 1400 in accordance with the present invention may further employ path diversity techniques for substantial elimination of fading and intersymbol interference. Multi-path transmission occurs when a transmitter module and a receiver module connected via an RF link are not both located inside the same anechoic chamber. Path diversity may provide different physical transmission paths with uncorrelated loss characteristics for a signal. In a preferred embodiment, RC aircraft device system may support a plurality of alternative paths for transmission. Supporting alternative paths may enable data packets to determine routes away from interferers and avoid multipath effects. If a receiver is mobile, different transmission paths may exhibit weakly correlated channel conditions. Transmitter module 1410 may determine an optimal path for signal transmission, or may divert a transmission if a signal path is inadequate. A path selection heuristic may be implemented to monitor a transmission path. If a current transmission path is not providing adequate data transmission, a system may avoid burst losses in an original path by diverting subsequent transmissions to an alternate path.

Transmitter module 1410 may include an integrated antenna. In a preferred embodiment, antenna may be an integrated 2.4 GHz folded dipole antenna. An integrated antenna may eliminate the need to utilize an existing antenna located on an existing controller. An integrated antenna may similarly eliminate a requirement of mounting an antenna to an existing controller. Antenna may also be rotated in two planes to provide optimal transmission capability.

A radio controlled system 1400 in accordance with the present invention may include two or more receivers 1430, 1440 integrated within one or more receiver modules 1420 coupled to a radio controlled device. Transmitter module 1410 may be capable of transmitting two or more discrete frequencies to transmit data redundantly in two or more time periods to two or more receiver modules. Receiver module 1420 may receive and de-spread data individually or simultaneously on transmitting frequencies. An initial link connection procedure may be performed with two or more receivers 1430, 1440 to set a minimum sensitivity. System may require correlation of multiple consecutive packets from two or more receiver modules.

Receiver module 1420 may be coupled to a debug port 1470 for outputting link statistics and service information over an asynchronous serious port. Embedded hardware and software debug features may be provided to operator and may provide access to processor emulator features such as start/stop processor, read/write memory, read/write I/O, download and control program execution and the like. Debug port 1470 may allow for full test and diagnostic sequences to be constructed. For example, parameters such as a processor's address bus, data bus and control function signals and the like may be monitored in real-time. Debug port 1470 may only be accessible to authorized persons. In a preferred embodiment, information on debug port interface may not be accessible by an operator.

RC system 1400 may include a method for automatically detecting and selecting model programming code. Conventional RC device controllers may be capable of storing programming information for multiple RC devices. For instance, an RC device controller may include a microcomputer for storing operational instructions for multiple models, enabling an RC device operator to operate multiple models from a single transmitter. An operator who may operate multiple RC devices must typically ensure that a transmitter is set for the device he desires to operate. A controller may enable model selection by including a SELECT MODEL menu. If an operator operates several RC devices from the same controller, he may incorrectly select model programming from a transmitter menu. While an RC device may operate on an incorrect model program, it is highly likely that an operator will lose control of the device, potentially resulting in damage to or destruction of the device and other nearby devices. A system in accordance with the present invention may prevent an RC device from operating on an incorrect model program. System may control transmitter programming and link an RC device to a correct model program. In a preferred embodiment, a transmitter may send a signal to one or more receivers. Receiver may receive signal from the transmitter, and a digitally encoded message may be sent from a receiver to the transmitter. Digitally encoded message may include information regarding a receiver's model. Digitally encoded message may modify a previously stored model selection or a current model selection made by an operator to correspond with received receiver model information. In an alternative embodiment, a GUID associated with a receiver module or a transmitter module may be employed to indicate a particular receiver which may be utilized by the transmitter module to operate according to programming instructions associated with the receiver.

It is believed that the method and system of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof.

What is claimed is:

1. A radio control system for controlling a radio controlled (RC) model device comprising:

an add-on transmitter module, said add-on transmitter module configured for removable coupling to a controller which includes at least one control input and said add-on transmitter module configured for removable mounting within a receptacle of said controller, said add-on transmitter module further comprises an integrated antenna coupled to said add-on transmitter module; and an add-on receiver module configured for removable coupling to said radio controlled (RC) model device, said radio controlled (RC) model device including at least one motor to allow movement of said radio controlled (RC) model device, said add-on receiver module being suitable for receiving a control instruction regarding operation of said at least one motor from said add-on transmitter module of said controller via a spread spectrum modulated digital radio frequency link, said spread spectrum modulated digital radio frequency link is suitable for back-channel transmission of data from said add-on receiver module of said radio controlled (RC) model device to said add-on transmitter module, said back-channel transmission of data includes real-time operating information regarding said radio controlled (RC) model device, wherein said add-on receiver module only recognizes signals from said add-on transmitter module, said add-on transmitter module and said add-on receiver module transmit active packets and binding packets, said binding packets include fail-safe data, said add-on receiver module is configured to reconstruct lost packets by monitoring data of a last received packet.

2. The system as claimed in claim 1, wherein said control instruction is transmitted via a packet across a streaming transmission.

3. The system as claimed in claim 1, wherein said packet represents an entire operating state for said radio controlled (RC) model device.

4. The system as claimed in claim 1, wherein the real-time operating information includes speed, revolutions per minute, temperature and signal strength.

5. The system as claimed in claim 1, wherein said antenna is a 2.4 GHz folded dipole antenna.

6. A radio control system for controlling a radio controlled (RC) model device comprising:

an add-on transmitter module, said add-on transmitter module configured for removable coupling to a controller which includes at least one control input and said add-on transmitter module configured for removable mounting within a receptacle of said controller, said add-on transmitter module further comprises an integrated antenna coupled to said add-on transmitter module; and an add-on receiver module configured for removable coupling to said radio controlled (RC) model device, said radio controlled (RC) model device including at least one motor to allow movement of said radio controlled (RC) model device, said add-on receiver module being suitable for receiving a control instruction regarding operation of said at least one motor from said add-on transmitter module of said controller via a spread spectrum modulated digital radio frequency link, said spread spectrum modulated digital radio frequency link is suitable for back-channel transmission of data from said add-on receiver module of said radio controlled (RC) model device to said add-on transmitter module, said back-channel transmission of data includes real-time operating information regarding said radio controlled (RC) model device, wherein said add-on transmitter module and said add-on receiver module transmit active packets and binding packets, said binding packets include fail-safe data, said add-on receiver module is configured to reconstruct lost packets by monitoring data of a last received packet.

* * * * *